US005959406A

United States Patent [19]

Hart et al.

[11] Patent Number: 5,959,406

[45] Date of Patent: Sep. 28, 1999

[54] TRAVELING WAVE TUBE WITH EXPANDING RESILIENT SUPPORT ELEMENTS

[75] Inventors: Stephen L. Hart, Torrance; Elmer E. Reed, Jr., Palos Verdes Peninsula, both of Calif.

[73] Assignee: Hughes Electronics Corporation, El Segundo, Calif.

[21] Appl. No.: 08/518,631

[22] Filed: Aug. 23, 1995

Related U.S. Application Data

[51] Int. Cl.[6] ..... H01J 25/34; H01J 23/087

[52] U.S. Cl. ..... 315/3.5; 315/5.35; 29/600; 29/602.1

[58] Field of Search ..... 315/3.5, 5.35; 313/22, 24, 35, 36; 335/300, 299; 29/600, 602.1

[56] References Cited

U.S. PATENT DOCUMENTS

| | | | |
|---|---|---|---|
| 2,746,775 | 5/1956 | Leonard | 313/36 X |
| 3,292,239 | 12/1966 | Sadler | 29/600 X |
| 3,384,160 | 5/1968 | Buertheret | 313/35 X |
| 3,866,085 | 2/1975 | James | 315/5.35 X |

*Primary Examiner*—Benny T. Lee

*Attorney, Agent, or Firm*—Georgann S. Grunebach; M.W. Sales

[57] ABSTRACT

A coupled cavity traveling tube employs a number of adjacent stacked annular magnetic coils (52*a*–52*l*) of insulated copper tape mounted on a housing (40) that contains an electron beam path (22) surrounded by a coupled cavity circuit (42,44). An electron beam that is focused by the annular magnetic coils is projected by an electron gun (10) at one end of the traveling wave tube to a collector (26) at the other end of the electron beam path. RF input and output ports (48,50) are coupled to opposite ends of the coupled cavity circuit, with the entire assembly mounted in an outermost device housing (12,28,36) that is sealed to and around the externally projecting RF input and output ports by a pair of sealing rings (60,62) that circumscribe coils (52*b*,52*c*,52*l*) at opposite ends of the traveling wave tube. Hot melt plastic (58*a*–58*i*) is injected into spaces between adjacent ones of the annular coils to firmly position the stack of coils against shock and vibration. Expandable support elements (80,82) are positioned in intercoil spaces that are inaccessible because of the sealing rings. The expandable support elements respond to flowing cooling oil by expanding to resiliently urge the coils that they contact in axial directions, thereby exerting axially directed resilient compressive forces on the entire stack of coils to stabilize their position and resist shock and vibration to which the traveling wave tube may be subjected.

11 Claims, 2 Drawing Sheets

TRAVELING WAVE TUBE WITH EXPANDING RESILIENT SUPPORT ELEMENTS

BACKGROUND OF THE INVENTION

1. Field of the Invention

The present invention relates to support elements, and more particularly concerns support elements for interior areas that are difficult to access.

2. Description of Related Art

Assemblies of various types incorporating multiple elements confined within a space that has limited or difficult access may experience undesired motion, accelerations and vibration in response to shock, acceleration and vibration to which the overall device may be subjected. Such external forces can cause damage to the parts or to the overall system unless parts, which are otherwise loosely held to one another in a particular position, are firmly stabilized. A traveling wave tube is but one example of a system having a number of internal parts which must be firmly positioned and stabilized against external shock, acceleration and vibration. One such type of traveling wave tube, an elongated coupled cavity traveling wave tube, incorporates an elongated coupled cavity circuit, coupled at opposite ends to input and output RF ports, and surrounding a tube through which an electron beam is projected from an electron gun at one end of the tube to a collector at the other end. To focus the electron beam within the electron beam tube, a plurality of annular magnetic coils (twelve, in one system), termed a solenoid, are arranged in an elongated stack surrounding the coupled cavity circuit and effectively extend from one RF port to the other. The entire system is mounted in an exterior device housing that is sealed around the input and output RF ports by means of input and output port sealing rings that surround some of the magnetic coils. Spaces between adjacent ones of the magnetic coils are partly filled by insertion of stabilizing elements to stabilize coil positions. However, the intercoil space at the position of each of the sealing rings is not accessible to positioning of a stabilizing element after assembly of the coils. The sealing rings prevent the application of hot melt plastic to spaces in these positions.

In prior coupled cavity traveling wave tubes these inaccessible intercoil spaces have been merely left as dead, unoccupied spaces. Alternatively, solid or resilient elements have been positioned in these spaces prior to the stacking of the annular coils on the coupled cavity circuit. When the stacking has been completed in such an arrangement, and before the stabilizing elements are inserted, the coils are relatively loose in the axial direction with respect to one another, defining intercoil spaces that are then filled with stabilizing elements, such as, for example, by injection of hot melt plastic. However, since at least one or generally two of the intercoil spaces, namely those to which access is prevented by the presence of the sealing rings, cannot be filled with the stabilizing element after assembly of the stack, the cumulative effect of varying position and relative axial motion of one coil with respect to another effectively results in an inability to firmly stabilize position and longitudinal motion of the coils. Tube operation may be degraded by vibration or other movement of the coils and tube life is limited by vibration induced wear on the coils. Accordingly, prior coupled cavity traveling wave tubes have exhibited increased and undesirable sensitivity to external shock and vibration that degrades performance and decreases tube life.

It is an object of the present invention to avoid or minimize above mentioned problems.

SUMMARY OF THE INVENTION

In carrying out principles of the present invention in accordance with a preferred embodiment thereof, a stabilized assembly comprising a housing and first and second mutually spaced elements confined together with a liquid in the housing is provided with an initially dry expanding support device interposed between the elements, wherein the expanding support device comprises a body of material that expands upon contact with liquid. The body of the dry expanding support device, when contacted by the liquid, expands and presses against both of the first and second elements and exerts forces thereon that tend to press them away from each other. According to a particular feature, the spaced elements comprise two elements of a stack of similar elements with stabilizing members fixedly interposed between adjacent ones of the stack elements other than the two spaced elements, so that the stabilizing members, together with the expanding support device, form position maintaining spacers between the elements of each pair of adjacent elements of the entire stack.

According to another feature of the invention, and according to a specific embodiment thereof, a traveling wave tube includes an outermost device housing having first and second end pieces axially spaced from one another, an elongated tubular tuned cavity circuit housing supported in the device housing, a plurality of mutually spaced magnetic coils on the circuit housing within the device housing, and means for flowing liquid past the coils. A sealing ring extends around a portion of at least one of the coils, and a plurality of stabilizing spacers are interposed between adjacent ones of the other coils. An expandable spacer is positioned against at least one side of the one coil that is associated with the sealing ring, wherein the expandable spacer includes a body of material that expands upon contact with the liquid within the device housing.

BRIEF DESCRIPTION OF THE DRAWINGS

In the accompanying drawings:

FIG. 4 is a flow chart illustrating the assembly steps for the coupled cavity traveling wave tube in accordance with the present invention.

DESCRIPTION OF THE PREFERRED EMBODIMENTS

The present invention is applicable to a wide variety of different devices and systems in which support or thrust pressure is required in ordinarily nonaccessible areas of an assembly. Such devices include transformers and power supplies. Nevertheless, as the present invention has been initially incorporated in a coupled cavity traveling wave tube, its configuration, application and operation will be described in connection with its use in a such a coupled cavity traveling wave tube.

The drawings illustrate a coupled cavity traveling wave tube that is shown solely for purposes of exposition, as it will be readily appreciated that the invention may be applied to many other and different types of traveling wave tubes, and of course to types of structures other than traveling wave tubes.

Figure 1:
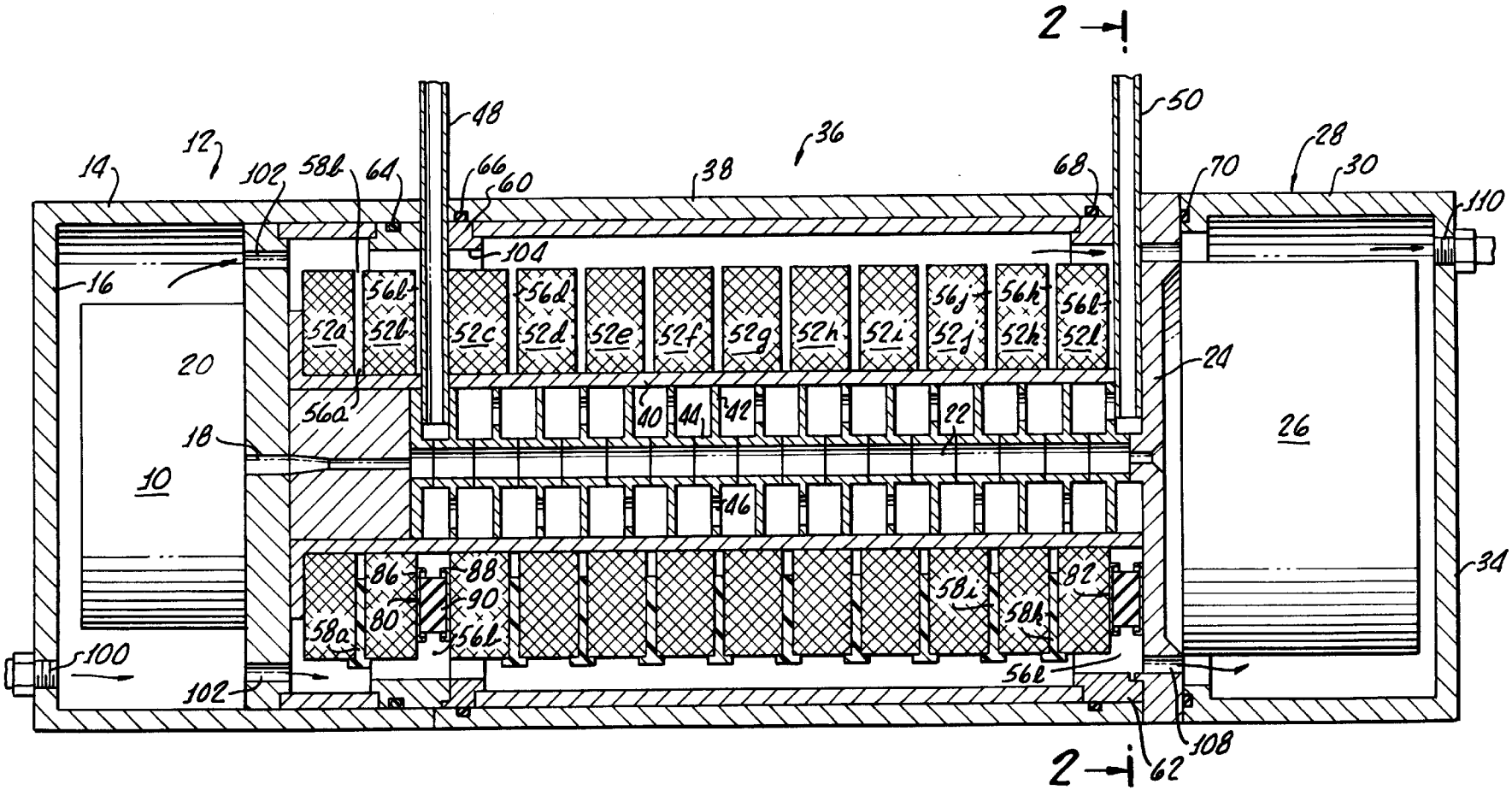
FIG. 1 is a simplified longitudinal cross-sectional view of a coupled cavity traveling wave tube incorporating expandable support elements of the present invention.

As illustrated in FIG. 1, an electron gun 10 is mounted by suitable means (not shown) in a gun "can" or gun housing 12 comprising a cylindrical gun can section 14 having a sealed housing end wall 16. The electron gun generates and projects an electron beam 18 through a central aperture in a first pole piece 20 and thence through a tubular electron beam path 22 that extends from the pole piece 20, through the device and through a second pole piece 24 at the other end of the device to a collector structure 26 mounted by means (not shown) in a collector "can" or collector housing 28 that includes a tubular collector can section 30 fixed and sealed to a collector can end wall 34. Pole pieces 20,24 close and seal inner ends of gun section 14 and collector section 30.

Interconnecting the gun housing 12 and the collector housing 28 is an intermediate can or housing section 36 formed by concentric inner and outer intermediate housing tubes 37,38. Outer tube 38 has the same diameter as each of the gun and collector cans 12 and 28 and has axially outer ends abutting the axially inwardly directed ends of the gun and collector cans and brazed thereto to provide a unitary sealed exterior device housing of generally tubular configuration.

Mounted within the intermediate housing section 36 and fixed at its ends to the first and second pole pieces 20 and 24 is a coupled cavity circuit tube 40 that is coaxial with the electron beam path 22, and preferably made of a suitable dielectric material such as phenolic resin or the like. An elongated coupled cavity circuit is formed of a plurality of discs, such as disc 42, each having a central ferrule 44. Inner surfaces of these ferrules collectively define the tubular electron beam path 22 (see FIG. 2). Discs 42 have outer peripheral edges bonded to the coupled cavity circuit tube 40 and ferrules 44 are brazed together in end to end abutting relation. Each of the discs 42 has an elongated opening 46 extending in a curved path around a portion of the disc to enable coupling of radio frequency signals from one cavity to the next adjacent cavity. The series of discs and ferrules extends from the output pole piece 24, at the collector can, to an RF input wave guide or RF input port 48. Waveguide 48 extends radially outwardly from an inner end that is positioned at and coupled to coupled cavity circuit tube 40 to the exterior of the outer housing 12,28 and housing section 36.

A similar RF output wave guide or RF output port 50 has an inner end positioned at and coupled with the endmost cavity of the coupled cavity circuit and extends radially outwardly through the exterior device housing to provide an RF output of the device.

An electron beam focusing magnetic field is provided by a solenoid formed by a series of annular magnetic coils 52*a*, 52*b*, 52*c*, 52*d*, 52*e*, 52*f*, 52*g*, 52*h*, 52*i*, 52*j*, 52*k*, and 52*l* (12 in number in this exemplary embodiment) which are mounted on the coupled cavity circuit tube 40 and extend along the full length of the coupled cavity circuit, as illustrated in FIG. 1. The twelve annular coils 52*a*–52*l* are each formed of a strip of insulated copper tape individually wound on tube 40 and electrically connected as a single coil (e.g., the coils are all connected in series with one another). When the magnetic electron beam focusing coils 52*a*–52*l* are positioned on the coupled cavity circuit tube 40 they define annular intercoil spaces 56*a*, 56*b*, 56*c*, 56*d*, 56*e*, 56*f*, 56*g*, 56*h*, 56*i*, 56*j*, 56*k* and 56*l*. An output port space 56*l* is defined between the endmost coil 52*l* and the collector end pole piece 24. In this space 56*l* is received the output wave guide 50. Similarly, the space 56*b* between coils 52*b* and 52*c* may be termed a input port space and receives the input wave guide 48. Annular intercoil spaces 56*c*–56*k* are defined between respective magnetic coils 52*c*–52*l*. The input and output wave guides 48,50 extend radially through upper portions of these annular input and output port spaces. The spaces between the magnetic coils allow positioning of a somewhat resilient intercoil stabilizing element which, in an exemplary embodiment, is provided in the form of a hot melt plastic that is injected into those of the intercoil spaces 56*a*, 56*c*–56*k* that are accessible after the sealing rings are positioned.

Completely surrounding portions of a pair of adjacent coils 52*b* and 52*c* and surrounding input port space 56*b* is a first sealing ring 60 having an opening through which the input wave guide 48 passes. The wave guide 48 is brazed to or otherwise sealed to the opening in the sealing ring 60. Similarly, at the collector end of the coupled cavity circuit, a second sealing ring 62 completely surrounds the endmost coil 52*l* and cooperates with the pole piece 24 to form an opening through which passes the output wave guide 50. The wave guide is sealed to this opening in the sealing ring 62 and pole piece 24 by being brazed or otherwise bonded thereto. The exterior of the sealing rings are sealed to the exterior device housing 12 and 28 and housing section 36 by means of o-rings 64,66,68, and 70. The sealing rings are held in place by supporting struts, such as struts 63 shown in FIG. 2 as extending in tangential contact with tube 40 between spaced points on the interior of each sealing ring. The struts are fixed to the tube and to the sealing rings.

FIG. 1 illustrates hot melt plastic bodies 58*a*, 58*b*, 58*c*, 58*d*, 58*e*, 58*f*, 58*g*, 58*h*, 58*i* and 58*j* interposed between adjacent ones of the coils, except that plastic bodies 58*b*–58*j* are adjacent to coils 52*c*–52*l*, respectively. All of the intercoil spaces, excepting only the input port intercoil space 56*b* and the endmost or output port space 56*l*, are accessible to injection of hot melt plastic. Such plastic is injected in small discrete areas between the coils at three different circumferentially spaced locations in each intercoil space, which locations are equally spaced at 120° intervals around of each intercoil space.

However, because the input port space 56*b* and the output port space 56*l* are completely surrounded by the continuous input port sealing ring 60 and the continuous output port sealing ring 62, the input and output port intercoil spaces 56*b* and 56*l* are not accessible to the hot melt plastic injection gun. Thus hot melt plastic cannot be injected into these spaces. In some prior art devices these spaces have been left as dead spaces.

Omitting, at this point, a description of expandable support elements 80*a*, 80*b*, 80*c* and 82*a*, 82*b* and 82*c* (described in detail below) that are located in the input and output intercoil spaces 56*b* and 56*l* (only elements 80*a* and 82*a* are illustrated in FIG. 1), the described tube operates in a conventional manner to amplify an RF input signal. An RF input signal is provided via input port 48, which couples the signal to the series of intercoupled tuned cavities 42 to output port 50 as an amplified copy of the input signal. The input RF signal is amplified by interaction with the electron beam that is generated by the electron or cathode ray gun 10 and projected through the path 22 and through the coupled cavities to the cathode ray collector 26. The series of magnetic coils 52*a*–52*l* (or solenoid), acts upon the electron beam in path 22 to keep it focused and confined within the path. The tuned RF signals in each of the cavities progressively interact with the electron beam projected along path 22 and extract energy from the electron beam to progressively increase amplitude of the RF signal at successive coupled cavities.

Figure 2:
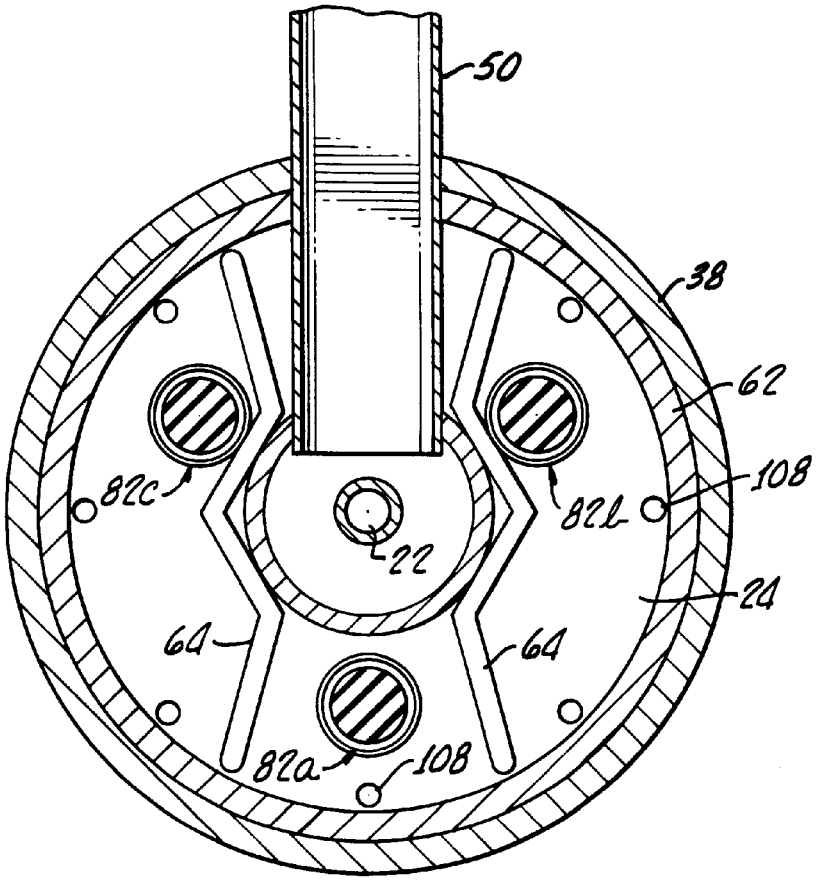
FIG. 2 is a section taken on lines 2—2 of FIG. 1.

According to principles of the present invention, the input and output port intercoil spaces 56*b* and 56*l*, inaccessible because of the presence of the sealing rings, are provided with expandable spacers that stabilize the entire stack of coils. Detailed assembly procedures will be described below. During assembly of the magnetic coils, after positioning of the sealing rings, but prior to the injection of the hot melt plastic, the input and output port spaces 56*b* and 56*l* (which are inaccessible to the hot melt plastic injection apparatus after positioning of the sealing rings) are each provided with sets of expandable elements, such as the set of elements 80*a*, 80*b*, and 80*c* in intercoil space 56*b* and the set of elements 82*a*, 82*b* and 82*c* in the endmost space 56*l* (only elements 80*a* and 82*a* are shown in FIG. 1). FIG. 1 illustrates that expandable elements 80*a* and 82*a* comprise end cups 86, 88 that sandwich circular disc shaped body 90, which are illustrated in greater detail in FIG. 3 and further described below. FIG. 2 is a cross sectional view taken along lines 2—2 in FIG. 1. FIG. 2 illustrates RF output port 50 extending into coupled cavity circuit tube 40. Intermediate housing tube 38 and seal ring 62 surround coupled cavity circuit tube 40, struts 63, expandable elements 82*a*, 82*b* and 82*c* and output pole piece 24. Struts 63 are positioned between expandable elements 82*b* and 82*c* and the coupled cavity circuit tube 40. In the center of the coupled cavity circuit tube 40, the electron beam path 22 surrounded by ferrule 44 of disc 42 are illustrated. Oil passage holes 108 are illustrated adjacent to the inner circumference of seal ring 62. As can be seen in the cross-section of FIG. 2, the set of elements 82*a*, 82*b* and 82*c* in intercoil space 56*l* is formed of three discrete expandable elements equally spaced circumferentially around the traveling wave tube. Similarly but not shown in the figures, the set of elements 80*a*, 80*b*, and 80*c* in intercoil space 56*b* is formed of three expandable elements equally spaced circumferentially around the traveling wave tube. Preferably, each of the hot melt plastic bodies 58*a*–58*j*, are also formed as three separate and discrete elements or spacers (not shown) equally spaced circumferentially around the tube, and each extending a relatively few degrees in the circumferential direction.

Figure 3:
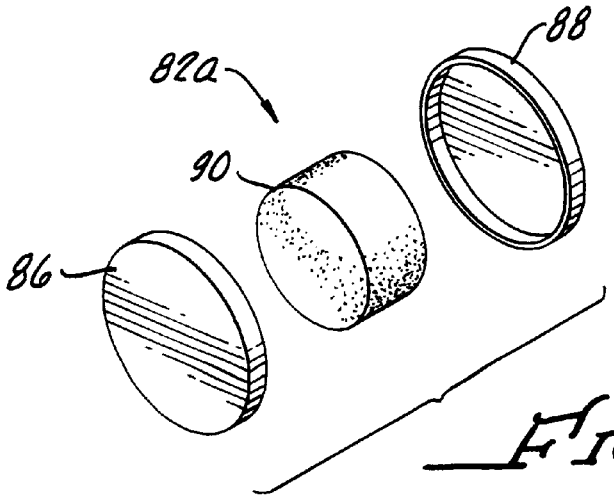
FIG. 3 is an exploded pictorial view of one expandable support element.

All of the expandable elements 80*a*–80*c* and 82*a*–82*c* are identical and each is formed as shown in the exploded view of FIG. 3. A pair of nonconductive, shallow, circular open cups or cup-shaped housings 86,88, as shown for expandable element 82*a* in FIG. 3, partly enclose and sandwich a circular disc shaped body 90 that is positioned between the cups 86,88. To hold these elements in place during assembly, they may be secured to each other and to the sides of adjacent coils or pole pieces by a drop of adhesive.

The disc shaped body 90 (see FIG. 3) of each of the expandable elements is formed of a material that expands when contacted with liquid. Many materials, rubber compounds such as ethylene propylene, butyl rubber and the like, for example, expand when wetted. In this embodiment the expandable disc shaped bodies 90 are made of a solid disc of ethylene polypropylene that reacts when wetted by a standard cooling oil, such as an oil made by Monsanto and known as Monsanto Coolanol 25R, to expand by as much as 45% both radially and axially. Other standard cooling oils may be obtained from Chevron Oil Co., Castrol Oil Co. and 3M. The cooling oil is caused to flow through the outer housing 12,28 and housing section 36 and over and around the individual coils as will be described below. In this an exemplary embodiment the expandable discs or bodies 90, which are three in number for the space 56*b* between coils 52*b* and 52*c* and are three in number for the space 56*b* between the pole piece 24 and coil 52*l*, has a diameter of about 0.62 inches and a thickness of about 0.12 inches. Obviously other sizes, shapes, thicknesses, diameters, and numbers of expandable elements circumferentially distributed in any given intercoil space be employed as deemed necessary or desirable.

During operation of the described traveling wave tube, cooling oil is caused to flow through the tube body and over and between the coils. As illustrated in FIG. 1 by arrows, oil flows into the electron gun housing through input openings 100, thence through openings 102 in pole piece 20. From openings 102 the oil flows into the annular space between the gun, collector and intermediate housing sections 14, 30, and 36 and the coupled cavity circuit tube 40. The oil flows through the annular space in which the magnetic coils are mounted, passing adjacent to the sealing rings 60 and 62 by means of oil flow openings 104,106 into collector can 28 and through openings 108 in the collector or end pole piece 24, to exit from the collector can 28 through exit oil openings 110. If deemed necessary or desirable, suitable baffles (not shown) may be provided in the annular space between the outer housing 36 and the coupled cavity circuit tube 40 to ensure a serpentine or more turbulent flow of the cooling oil over and around the magnetic coils.

In its flow around and over the magnetic coils, the oil comes in contact with each of the expandable support element discs 90 of element sets 80*a*–80*c* and 82*a*–82*c*. The liquid cooling oil wets the surface of the discs 90 and causes these elements to expand both radially and axially. Because the expandable support elements (e.g., the discs 90 and their supporting cups 86,88) are closely confined between sides of adjacent coils (in the case of the elements of set 80*a*–80*c*) and between the endmost coil and the pole piece (in the case of elements of expandable element set 82*a*–82*c*), the axial expansion of these elements exerts axially directed pressure on the adjacent coils and on the pole piece 24 and tends to compress the entire stack. The two pole pieces are fixedly interconnected by their fixed connection to the outer housing, and therefore limit axial expansion of the stack of coils. The hot melt plastic has a suitable degree of resilience so that the entire stack is somewhat compressed by the expansion of the several sets of expandable elements. Thus the coils are more firmly positioned and stabilized in their mounting on the tube structures by being pressed axially against the two pole pieces. The assembly is thus stabilized against undesired motion, accelerations, and vibrations.

In the assembly method of the described traveling wave tube the coupled cavity circuit is formed when as illustrated in FIG. 4, the coupled cavity discs 42 are assembled to define the electron beam path 22 and within the coupled cavity circuit tube 40. After the RF ports are connected to the circuit, the sealing rings 60,62 are positioned with respect to the coupled cavity circuit tube 40 and secured thereto by struts 63 (see FIG. 2), that extend across the sealing ring and tangent to the exterior of coupled cavity circuit tube 40. The struts may be bonded at points of contact with both the coupled cavity circuit tube 40 and the sealing ring. The input and output waveguide ports 48,50 are installed and sealed and brazed to the sealing rings. At this point in the assembly the outer housing sections, the gun, intermediate and collector sections 14,36,30 have not yet been installed.

As shown in the method illustrated by FIG. 4, the coils 52*a*–52*l* may be wound in place on the exterior of coupled cavity circuit tube 40. Certain coils are wound in a displaced position and then axially shifted so that a coil winding machine will not encounter interference with either the previously installed sealing rings or the previously installed wave RF input and output ports. As illustrated by the dashed line arrows in FIG. 4, the first coil that is wound is the coil in position number two, that is, coil 52*b*, the second from the left in FIG. 1. This coil is wound initially in the position to be finally occupied by the first coil 52*a* (which has not yet been wound at this time). After being wound, coil 52*b* is slid axially along the tube 40, (toward the input waveguide) to its final position, as illustrated in FIG. 1. Coil 52*b* is axially shifted until it abuts a strut 63. A shorting sheet or shorting piece of conductive material is positioned on the exterior of tube 40, and coil 52*a* is wound in place in its final position as illustrated in FIG. 1. At the start of the winding of coil 52*a*, it is electrically connected in series with the previously wound and axially shifted coil 52*b*, with the two coils being electrically connected by soldering to the interconnecting shorting piece.

After the first two coils 52*a* and 52*b* are wound, positioned and interconnected, the first set of expandable elements 80*a*–80*c* is positioned against one side of the coil 52*b*, where they are lightly held in place by a spot of adhesive or self jigging (see both dashed line and solid line arrows in FIG. 4). This step is referred to a 'Form and position first expandable spacer element' in FIG. 4. After placing the expandable elements 80*a*–80*c*, coil 52*c* is wound on the tube 40, but this coil is wound at a position axially displaced toward the output end of the tube from its final position, to avoid interference with the sealing ring 60. For example, coil 52*c* is initially wound at the position to be finally occupied by coil 52*e* (which is not yet wound). After coil 52*c* has been wound it is axially moved toward coil 52*b*, toward its illustrated (final) position, and interconnected with coil 52*b* by soldering a shorting sheet or wire between the two. When the third coil 52*c* is wound and axially positioned in its final position, it is pressed against cups 88 of the expandable element 80*a*–80*c* with a relatively light pressure. Similarly, successive coils 52*d*, 52*e*, etc. are individually and successively wound on the tube, with some of the coils being wound in axial position displaced from the final position and then axially slid into their final position. After winding each coil is electrically connected to its adjacent coil.

After the tenth coil (coil 52*j*) is wound as shown in the method illustrated by FIG 4, the second set of expandable elements 82*a*–82*c* is positioned and held in place against the output pole piece 24 by spots of adhesive that secure the expandable element cups to the pole piece. After the expandable elements 82*a*–82*c* are positioned, and after the tenth coil (coil 52*j*) has been wound in its illustrated position, but before the next to last coil 52*k* has been wound, the twelfth and last coil (coil 52*l*) is then wound on tube 40 (see dashed lined arrows in FIG. 4). This twelfth coil 52*l* is wound in the position that will be finally occupied by the eleventh coil (coil 52*k*). Coil 52*l* is then slid axially toward the collector end of the device into abutment with the cups of expandable elements 82*a*–82*c*. Finally, the eleventh coil (coil 52*k*) is wound in place and interconnected by shorting sheets to the adjacent coils.

Now all of the twelve coils are wound, interconnected and properly positioned axially, and both sets of expandable elements 80*a*–80*c*, 82*a*–82*c* are in place. The expandable discs or bodies 90 of the expandable elements are dry. The coils are positioned so as to define the previously described intercoil spaces 56*a*–56*l*. Into each of these spaces, except the RF input and output port spaces 56*b*–56*l* (now partly occupied by sets of expandable elements) is placed a set of discrete bodies 58*a*–58*j* of injectable hot melt plastic, as previously mentioned. As illustrated by the solid line arrows in FIG. 4, assembly of the traveling wave tube is completed by installation of the cathode ray tube gun and collector housings 12, 28, and installing the intermediate outer housing tubes 37,38, which are sealed to the sealing rings by the several o-rings and are positioned with ends in abutment with the gun housing 12 and collector housing 28 to which the axially outer ends of the intermediate housing tube 38 are brazed. These are the steps referred to as 'Seal device housing' and 'Couple electron gun and electron collector' in FIG. 4.

An integral part of the method shown in FIG. 4 is the addition of cooling liquid ports in the sealed device housing. During operation of the described traveling wave tube a cooling oil is caused to flow through the tube and is then fed to a heat exchanger (not shown) which extracts heat from the cooling oil so that the cooled oil may be returned to the cooling system pump to be recirculated through the traveling wave tube. The wetting of the expandable element sets 80*a*–80*c*, 82*a*–82*c* by the cooling oil causes these to expand and to axially compress the stack of magnetic coils one against the other, thereby to stabilize and effectively rigidify the stack of magnetic coils.

What is claimed is:

1. A method of assembling a traveling wave tube comprising the steps of:

forming a coupled cavity circuit with an elongated axis and having an electron beam path that extends along said axis in a housing having first and second end pieces, connecting input and output RF ports to said coupled cavity circuit, positioning a first sealing ring about said RF input port, positioning a second sealing ring about said RF output port, stacking a plurality of magnetic coils on said coupled cavity circuit in a mutually spaced relation to one another along said coupled cavity circuit to define intercoil spaces between adjacent ones of said plurality of coils, said plurality of magnetic coils including first and second coils forming a RF input port space therebetween, and including a last coil cooperating with said second end piece to form a RF output port space, inserting stabilizing members within the intercoil spaces other than said RF input port space and said RF output port space, forming first and second expandable spacer elements of a body of material that expands upon contact with liquid, positioning said first expandable spacer element in said RF input port space and said second expandable spacer element in said RF output port space, forming a sealed device housing over said magnetic coils, coupling an electron gun to one end of said electron beam path, coupling an electron collector to the other end of said electron beam path, and providing liquid ports in said sealed device housing configured and arranged to flow a liquid through the sealed device housing and over said coils and expandable spacer elements, whereby said expandable spacer elements expand in a direction when contacted by said liquid and exert pressure in said direction that is axial along said axis, tending to stabilize said mutually spaced relation of said coils in said assembly.

2. The method of claim 1, wherein said step of stacking comprises the step of:

positioning a last coil and a next to last coil in mutually adjacent last and next to last end positions adjacent said second end piece at said RF output port, comprising the steps of:

positioning said second expandable spacer element in a location immediately adjacent said second end piece, winding said last coil of said plurality of coils in said next to last end position, moving said last coil along said axial direction on said elongated coupled cavity circuit into engagement with said second expandable spacer element in the last end position, and winding said next to last coil in said next to last end position.

3. The method of claim 1 wherein the step of stacking a plurality of magnetic coils on said coupled cavity circuit comprises the step of:

positioning at least three of said plurality of coils in mutually adjacent first, second and third end positions adjacent said first end piece, winding a first coil in said first end position and sliding said first coil to said second end position, winding a second coil in said first end position, positioning said first expandable spacer element within said sealing ring and against said first coil in said second end position, winding a third coil in a position axially displaced along said axis from said third end position and from said first expandable spacer element, and moving said third coil along said axial direction on said elongated coupled cavity circuit to said third end position where aid third coil abuts one side of said first expandable spacer element, wherein said first sealing ring extends around said second and third positions and wherein said first and third magnetic coils occupy said second and third positions in the assembled traveling wave tube.

4. A stabilized assembly comprising:

a housing, first and second mutually spaced elements confined within said housing, a liquid in said housing, an expanding support device interposed between said first and second stacked elements, said expanding support device comprising a body of material that expands upon contact with said liquid, said body being in contact with said liquid and being expanded by such contact, said body pressing against both said first and second elements to exert forces upon said first and second elements tending to press said first element away from said second element, and a plurality of elements stacked side by side in said housing, said first element said second element and said plurality of stacked elements collectively define a stack; and stabilizing members fixedly interposed between adjacent ones of said plurality of stacked elements, whereby said stabilizing members and said expanding support device collectively define position maintaining spacers between said elements of said stack.

5. A stabilized assembly comprising:

a housing, first and second mutually spaced elements confined within said housing, a liquid in said housing, an expanding support device interposed between said first and second elements, said expanding support device comprising a body of material that expands upon contact with said liquid, said body being in contact with said liquid and being expanded by such contact, said body pressing against both said first and second elements to exert forces upon said first and second elements tending to press said first element away from said second element, wherein said expanding support device comprising a body of rubber; and a plurality of elements stacked side by side in said housing, said first element said second element and said plurality of stacked elements collectively define a stack; and stabilizing members fixedly interposed between adjacent ones of said plurality of stacked elements, whereby said stabilizing members and said expanding support device collectively define position maintaining spaces between said elements of said stack.

6. A stabilized assembly comprising:

a housing, first and second mutually spaced elements confined within said housing, a liquid in said housing, an expanding support device interposed between said first and second elements, said expanding support device comprising a body of material that expands upon contact with said liquid, said body being in contact with said liquid and being expanded by such contact, said body pressing against both said first and second elements to exert forces upon said first and second elements tending to press said first elements away from said second element, wherein said expanding support device comprising a rubber disc sandwiched between a pair of cup shaped holding elements, a plurality of elements stacked side by side in said housing, said first element and said second element and said plurality of stacked elements collectively define a stack; and stabilizing members fixedly interposed between adjacent ones of said plurality of stacked elements, whereby said stabilizing members and said expanding support collectively define position maintaining spaces between said elements of said stack.

7. A traveling wave tube comprising:

a device housing having first and second end pieces axially spaced from one another, an elongated tubular circuit housing supported in said device housing and extending between said end pieces, a plurality of mutually spaced magnetic coils on said tubular circuit housing and within the device housing, means for flowing a liquid in said device housing past said coils, a sealing ring extending around at least a first side of at least one of said coils, a plurality of stabilizing spacers interposed between adjacent ones of said coils, and an expandable spacer positioned against said first side of said at least one coil, said expandable spacer including a body of material that expands upon contact with said liquid.

8. The traveling wave tube of claim 7 further comprising:

a tubular electron beam path within said elongated tubular circuit housing;

an electron gun connected to said first end piece to project an electron beam through said electron beam path;

a collector positioned adjacent to said second end piece to receive the electron beam projected through said electron beam path;

an RF input port;

an elongated coupled cavity circuit in said tubular circuit housing extending along said electron beam path and having one end coupled to said RF input port;

an RF output port coupled to the other end of said coupled cavity circuit, said sealing ring being sealed to one of said RF ports; and said means for flowing a liquid comprise ports for receiving said liquid in said device housing.

9. The traveling wave tube of claim 7 wherein pairs of adjacent ones of said plurality of coils of define a plurality of intercoil spaces, said sealing ring extends around and blocks access to one of said plurality of intercoil spaces, and wherein said expandable spacer is positioned in said one intercoil space.

10. The traveling wave tube of claim 9 wherein said expandable spacer comprises a rubber disc, and wherein said liquid is a cooling oil.

11. The traveling wavetube of claim 10 wherein said rubber disc comprises ethylene polypropylene.

* * * * *